United States Patent [19]

Fifer et al.

[11] 4,379,007

[45] Apr. 5, 1983

[54] CATALYSTS FOR NITRAMINE PROPELLANTS

[75] Inventors: Robert A. Fifer, Bel Air; James E. Cole, Aberdeen, both of Md.

[73] Assignee: The United States of America as represented by the Secretary of the Army, Washington, D.C.

[21] Appl. No.: 244,434

[22] Filed: Mar. 16, 1981

[51] Int. Cl.[3] ..... C06B 43/00

[52] U.S. Cl. ..... 149/22; 149/92

[58] Field of Search ..... 149/22, 92

[56] References Cited

U.S. PATENT DOCUMENTS

| | | | |
|---|---|---|---|
| 3,617,404 | 11/1971 | Lyerly | 149/92 |
| 3,791,893 | 2/1974 | Hill | 149/92 X |
| 3,882,037 | 5/1975 | Brown | 149/22 X |
| 4,050,968 | 9/1977 | Goldhagen et al. | 149/92 X |
| 4,061,512 | 12/1977 | Chew et al. | 149/22 |
| 4,172,743 | 10/1979 | Goddard | 149/22 X |

*Primary Examiner*—Stephen J. Lechert, Jr.

*Attorney, Agent, or Firm*—Nathan Edelberg; Robert P. Gibson; A. Victor Erkkila

[57] ABSTRACT

This invention relates to novel nitramine propellant compositions for guns and rockets.

11 Claims, No Drawings

CATALYSTS FOR NITRAMINE PROPELLANTS

GOVERNMENTAL INTEREST

The invention described herein may be manufactured, used and licensed by the Government for Government purposes without the payment to us of any royalties therein.

BACKGROUND OF THE INVENTION

There is a continuing trend towards increasing the energy and performance of gun and rocket propellants. Thus, nitrocellulose-based propellants are gradually being replaced by propellants containing high energy organic nitramines, such as RDX (1,3,5-trinitro-1,3,5-triazacyclohexane) and HMX (1,3,5,7-tetranitro-1,3,5,7-tetraazacyclooctane). Typical nitramine type propellants may consist of 60 to 80 weight percent of RDX or HMX and the remainder being composed of an energetic binder, such as nitrocellulose, or an "inert" (i.e. low energy) binder such as cellulose acetate or polyurethane. Further, a typical nitramine propellant has a burn rate of 1 cm/s at 5 MPa (725 psi), 9 cm/s at 50 MPa (7,250 psi) and 70 cm/s at 500 MPa (72,500 psi). Due to binder suppression effects, the burn rate at low pressure (below 20 or 30 MPa) for inert binders and/or nitramine particle sizes of more than a few microns may fall below these values. For many years attempts have been made to reduce or eliminate such low pressure binder suppression effects (and the resulting "slope breaks" in the burn rate vs. pressure curves) to decrease the pressure dependence of the burn rate or to increase the burn rate over a large pressure range.

Higher burn rates would be desirable for both rocket and gun applications, since they would require a smaller burning surface area for a given gas generation rate, which in turn would permit a larger propellant "web". This would make not only the grain manufacture more economical, but also would make it possible to design more efficient and reliable rocket engines as well as guns with greater ballistic efficiency and hence higher muzzle velocities for a given peak chamber pressure.

Prior to the present invention all reported attempts to increase the burning rates of nitramine propellants with "catalysts" have been only marginally successful at best. This is particularly true for the cyclic nitramines such as RDX and HMX which seem very immune to catalytic effects. Most attempts to catalyze nitramines have involved metal salts, since many of them are known to be effective with nitrocellulose-based propellants. Generally, the anions have been oxygen (metal oxides), halides (F, Cl, Br), organics (e.g. oxalates, salicylates) or inorganic oxidizers (e.g. $NO_3$, $ClO_4$). All of these anions can be considered to be oxidizers, since they either contribute oxygen or take up hydrogen. Thus, for example, A. P. Glaskova "The Effect of Catalysts on the Combustion of Explosives", Combustion, Explosive and Shock Waves, 10(3), 281-90(1974) investigated the effect of a large number of additives on the burn rate of RDX, including NaF, CuCl, $KClO_4$, $KNO_3$, cobalt-and copper oxalate and sodium salicylate, and found that none of them increased the burn rate noticeably. B. B. Goshgarian, "Chemical Ingredient Studies Task II-HMX Additive Studies", Air Force Rocket Propulsion Laboratory, Technical Report 79-59(July 1979) found that propellants made with HMX coated with ammonium perchlorate or $(CH_3)_4NNO_3$ had higher burn rates at low pressure. However, the increase was less than a factor of two and was present only in the 3.45–20.7 $MP_a$ (500–3000 psi) region. K. P. McCarty, "HMX Propellant Combustion Studies," Air Force Rocket Propulsion Laboratory, Technical Report 79-61 (November 1979) found that some burn rate acceleration below 7 $MP_a$ (1000 psi) was obtained for a 50%-HMX-50% double based propellant by addition of $Pb_2O_3$ and a mixture $Pb_2O_3$ and $SnO_2$, but that no burn rate increase was found when the HMX content was increased to 70% or if an inert binder was employed. The catalysis observed with the double base energetic binder was probably due simply to catalysis of the nitrocellulose in the binder, since $Pb_2O_3$ is known to be an effective catalyst for nitrocellulose and double base propellants.

Accordingly, it appears that prior to the present invention, no catalysts have been shown to be capable of accelerating the burn rate of nitramines and nitramine propellants except under very low pressure conditions where the binder controls the burn rate.

SUMMARY OF THE INVENTION

It has been unexpectedly found that the burn rate of nitramine propellants can be significantly increased over a wide range of pressures by incorporating therein a metal tetrahydridoborohydride of the formular $Me(BH_4)_x$, wherein Me represents an alkali metal or an alkaline earth metal, and x is 1 when Me is an alkali metal and X is 2 when Me is an alkaline earth metal. Besides increasing the burn rate of nitramine propellants, the novel metal tetrahydridoborohydride catalysts provide other important advantages, including the following:

(1) The propellants are more readily ignited;

(2) due to the high hydrogen content of these metal borohydrides, the molecular weight of the combustion products is decreased, so that even though the propellant is cooled considerably, the impulse of the modified propellant in some cases equals or exceeds that of an unmodified propellant having the same flame temperature;

(3) unlike many other metal additives, these metal tetrahydridoborohydrides under many conditions do not produce condensed products in the hot combustion gases;

(4) the metal tetrahydridoborohydrides act as flash suppressants for guns or afterburning suppressants for rockets.

The metal tetrahydridoborohydride catalyst can be mixed with the nitramine and formulated into a solid propellant grain, preferably with the inclusion of a binder, in conventional manner. Suitable binders include inert binders, such as cellulose acetate, polyethylene, polypropylene, polyacrylates, epoxy resins and polyurethanes. Also energetic binders may be employed, such as nitrocellulose, dinitropropylacrylate polymers, and polymeric nitroethylenes. The propellant grain can contain the binder in amounts conventionally employed, e.g. up to about 50% of the total weight of the propellant. Further, the propellant compositions of the present invention may contain other additives conventionally employed in nitramine based propellants, e.g. other oxidizers such as ammonium nitrate and TNT, metals such as aluminum, carbon black, plasticizers, etc in amounts of about 0–20% of the total weight of the propellant. Preferably, the propellant compositions of the present invention contain the nitramine component in amount of about 50–80% of the total weight of the propellant composition.

The novel metal tetrahydridoborohydride catalysts, including mixtures thereof, are effective for improving the ignition and combustion characteristics of nitramine propellants generally, including but not limited to RDX, HMX, Tetryl (2,4,6-trinitrophenyl methyl nitramine, NGU (nitroguanidine) and EDNA (ethylenedinitramine). Nitramine compounds employed in gun and rocket propellant compositions usually have a particle size below 1000 microns and often as low as 1–20 microns.

Specific examples of alkali metal tetrahydridoborohydrides include lithium tetrahydridoborohydride, sodium tetrahydridoborohydride, potassium tetrahydridoborohydride, and rubidium tetrahydridoborohydride. Specific examples of alkaline earth metal tetrahydridoborohydrides include magnesium tetrahydridoborohydride, beryllium tetrahydridoborohydride, calcium tetrahydridoborohydride, barium tetrahydridoborohydride and strontium tetrahydridoborohydride.

Small amounts of metal tetrahydridoborohydrides, e.g. as low 1% by weight of the nitramine, are effective for increasing the burning rate of nitramine propellants. Excellent results can be obtained by employing the metal tetrahydridoborohydrides in an amount of about 10% by weight of the nitramine component, whereby burning rates several times higher than that obtained with the unmodified propellant are obtained. Amounts of such metal tetrahydridoborohydrides up to 20% or more by weight of the nitramine are also effective to increase the burning rate of nitramine propellants; however, the use of such larger amounts is less desirable, since it reduces the proportion of nitramine and hence the energy output of the propellant.

The following examples provide specific illustrations of the nitramine propellant compositions of the present invention.

EXAMPLE 1

The catalytic effects of metal tetrahydridoborohydrides with HMX were demonstrated in closed bomb tests as follows:

10.329 grams of HMX having a particle size of 150–300 microns were mixed with 1.033 grams of commercial grade $LiBH_4$ of fine particle size. The mixture weighing 11.362 grams was loaded into a test bomb of 90 cc. volume, (corresponding to a bomb loading density of 0.12 g/cc.), and ignited with a standard M52 primer.

A comparative test was carried out by igniting 11.362 grams of HMX of 150–300 microns particle size in identical manner except that the $LiBH_4$ was omitted.

The pressure-time traces obtained in the tests showed the following results:

With HMX alone: Ignition was slow, the pressure rose very slowly for the first 3–4 milliseconds. Burning then occurred, requiring about 0.6 millisecond to go from 10% to 90% of peak pressure of about 193 MPa (28,000 psi).

With HMX-10% $LiBH_4$ at the same loading density: The ignition time was reduced to less than 1 millisecond and the time required to go from 10% to 90% of peak pressure (which was slightly lower than with HMX alone) was reduced to about 0.05 millisecond.

These pressure-time traces indicated that at both high and low pressures, the $LiBH_4$ increased the burn rate of the HMX approximately by an order of magnitude or more.

When lithium hydride (LiH) or ammonia borane ($NH_3BH_3$) was employed in place of lithium tetrahydridoborohydride in the foregoing example, no improvement in the ignition or burn rate of the HMX was observed, suggesting that the $BH_4$ group of the metal tetrahydridoborohydride rather than the metal, hydrogen or the boron, was responsible for the observed catalytic effects.

EXAMPLE 2

The procedure of example 1 was repeated except that powdered sodium tetrahydridoborohydride ($NaBH_4$) was employed in place of lithium tetrahydridoborohydride. The ignition rate and burning rate of the HMX-$NaBH_4$ mixture were similarly increased over that of the HMX product containing no $NaBH_4$.

EXAMPLE 3

The procedure of example 1 was repeated except that $NaHB_4$ was employed in place of $LiBH_4$ and RDX having a particle size of 150 to 300 microns was employed in place of HMX. The ignition and burning rates of the RDX-$NaBH_4$ mixture were similarly increased over that obtained with the RDX product containing no $NaBH_4$.

EXAMPLE 4

This example illustrates the accelerating action of lithium tetrahydridoborohydride on the combustion of HMX propellant containing a cellulose acetate binder measured in a constant pressure strand burner.

A mixture consisting of 70% by weight of HMX having a particle size of 150–300 microns and 30% by weight of powdered cellulose acetate was compressed under high pressure in molds into strands 5 mm wide, 22 mm long and about 3 mm thick. Fuze wire ($\frac{1}{2}$ amp) was wrapped around each end and covered with narrow strips of insulating tape. One face (5×22 mm) of the strand was adhered to a wooden mount with epoxy resin while the other sides were inhibited with a thick coating of silicone grease. The propellant was ignited by an electrically heated wire resting against one end of the strand in a nitrogen atmosphere in a strand burner described in an article by J. E. Cole and R. A. Fifer, "Burn Rate Behavior of High Density Binderless HMX", 16th JANNAF Combustion Meeting, vol. 1, page 377, CPIA Publication 308 December 1979.

Several samples were thus prepared and all samples were prepared by weighing, mixing and mold filling in a "glove box" purged with nitrogen and pressing into strands at 420 MPa (61,000 psi). The samples were burned at 41.4 MPa (6000 psi), which is above the expected "slope break" region for these propellants.

Comparative tests were carried out under identical conditions with propellant strands prepared in the same manner from 30% cellulose acetate binder and 70% of a mixture of HMX of similar particle size and 10% added $LiBH_4$, i.e. 63.6% HMX and 6.4% $LiBH_4$.

The tests indicated that the burn rate of the HMX-cellulose acetate strand propellant was 4.6 cm/second whereas the burn rate of the strand propellant containing $LiBH_4$ was 33 cm/second (each value being the average of two runs). Thus, the $LiBH_4$ catalyst increased the burn rate of the HMX propellant containing cellulose acetate binder by over 700%.

EXAMPLE 5

The procedure of example 4 was repeated except that finely divided magnesium tetrahydridoborohydride ($Mg(BH_4)_2$) was employed in place of lithium tetrahydridoborohydride. The increase in burn rate of the HMX-CA propellant thus produced by means of the $Mg(BH_4)_2$ catalyst was somewhat less than that produced when $LiBH_4$ was employed in similar manner.

The following table sets forth thermochemical calculated values showing the effects of adding lithium-, sodium-, and potassium tetrahydridoborohydrides to HMX and HMX-cellulose acetate propellants. HMX without a binder represents the extreme case of a very hot propellant, while the HMX composition containing cellulose acetate binder represents a very cool propellant. The calculations show that propellants catalyzed by the metal tetrahydridoborohydrides have favorable, and in some cases improved impetuses and specific impulses compared to uncatalyzed propellants of the same flame temperature. Because of their high hydrogen content, the metal tetrahydridoborohydrides cause a favorable decrease in average molecular weight, M, of the combustion products due mostly to a decrease in the amount of $CO_2$ formed, and an increase in the amount of $H_2$. The effect is especially prominent with hot propellants, and is, as expected, greater the lower the atomic weight of the metal. (The $BH_4$ represents a higher percentage of the additive's weight of $LiBH_4$ than for $KBH_4$). For example, addition of 10% $LiBH_4$ to HMX decreases the flame temperature, T, over 700 deg (18%), but due to a decrease in M of 3.94 g/mole (16.3%), the impetus ($I=8.3147$ T/M Joules/g) decreases only 2%, and is actually higher than for an uncatalyzed propellant of the same 3250° K. flame temperature. Compositions containing the heavier $NaBH_4$ or $KBH_4$ have impetuses comparable to, or slightly lower than, those of uncatalyzed propellants of the same temperature.

TABLE

THERMOCHEMICAL CALCULATIONS*

| | HMX | HMX + 10% $LiBH_4$ | HMX + 10% $NaBH_4$ | HMX + 10% $KBH_4$ | 70% HMX 30% CA | 70% (HMX + 10% $LiBH_4$) 30% CA | 70% (HMX + 10% $NaBH_4$) 30% CA | 70% (HMX + 10% $KBH_4$) 30% CA |
|---|---|---|---|---|---|---|---|---|
| P (atm) | 1346 | 1318 | 1286 | 1269 | 898 | 830 | 808 | 800 |
| T (°K.) | 3964 | 3250 | 3534 | 3661 | 2236 | 1970 | 1971 | 1988 |
| M (g/mol) | 24.17 | 20.23 | 22.54 | 23.67 | 20.44 | 19.49 | 20.03 | 20.40 |
| I (J/g) | 1364 | 1336 | 1303 | 1245 | 910 | 841 | 818 | 810 |

*Constant volume, ideal gas, for loading density of 0.1 g/cc

The foregoing disclosure is merely illustrative of the principles of this invention and is not to be interpreted in a limiting sense. I wish it to be understood that I do not desire to be limited to the exact details of construction shown and described because obvious modifications will occur to a person skilled in the art.

We claim:

1. A propellant composition, which comprises a particulate organic nitramine propellant and an effective amount for burn rate acceleration of a metal tetrahydridoborohydride of the following formula: $Me(BH_4)_x$, wherein Me represents an alkali metal or an alkaline earth metal and x is 1 when Me is an alkali metal and x is 2 when Me is an alkaline earth metal.

2. A propellant composition according to claim 1, wherein the metal tetrahydridoborohydride is present in amount up to about 20% by weight of the nitramine compound.

3. A propellant composition according to claim 1, which additionally contains a binder.

4. A propellant composition according to claim 3, wherein a binder is present in amount up to about 50% by weight of the propellant composition.

5. A propellant composition according to claim 1, wherein the nitramine is at least one of the group consisting of 1,3,5-trinitro-1,3,5-triazacyclohexane and 1,3,5,7-tetranitro-1,3,5,7-tetraazacyclooctane.

6. A propellant composition according to claim 1 or 5, wherein Me is at least one of the group consisting of lithium, sodium, potassium, beryllium, magnesium and calcium.

7. A propellant composition according to claim 1 or 5, wherein Me is sodium or magnesium.

8. A method of increasing the burn rate of a nitramine propellant, which comprises incorporating therewith an effective amount for burn rate acceleration of a metal tetrahydridoborohydride of the formular $Me(BH_4)_x$, wherein Me represents an alkali metal or an alkaline earth metal and x is 1 when Me is an alkali metal and x is 2 when Me is an alkaline earth metal.

9. A method according to claim 8, wherein the nitramine is at least one of the group consisting of 1,3,5-trinitro-1,3,5-triazacyclohexane and 1,3,5,7-tetranitro-1,3,5,7-tetraazacyclooctane.

10. A method according to claim 8 or 9, wherein the metal is at least one of the group consisting of lithium, sodium, potassium, beryllium, magnesium and calcium.

11. A method according to claim 8 or 9, wherein Me is sodium or magnesium.

* * * * *